US008967296B2

(12) United States Patent
Downton et al.

(10) Patent No.: US 8,967,296 B2
(45) Date of Patent: Mar. 3, 2015

(54) ROTARY STEERABLE DRILLING APPARATUS AND METHOD

(75) Inventors: Geoff Downton, Minchinhampton (GB); David L. Smith, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 899 days.

(21) Appl. No.: 11/421,147

(22) Filed: May 31, 2006

(65) Prior Publication Data

US 2008/0083567 A1 Apr. 10, 2008

(51) Int. Cl.
*E21B 7/06* (2006.01)

(52) U.S. Cl.
CPC ..... *E21B 7/067* (2013.01)
USPC ..... 175/61; 175/73

(58) Field of Classification Search
USPC ..... 175/61, 73, 74, 75, 256
See application file for complete search history.

(56) References Cited

U.S. PATENT DOCUMENTS 5,139,094 A * 8/1992 Prevedel et al. ..... 175/61
5,341,886 A * 8/1994 Patton ..... 175/24
5,343,967 A * 9/1994 Kruger et al. ..... 175/75
5,803,185 A * 9/1998 Barr et al. ..... 175/45
5,857,531 A * 1/1999 Estep et al. ..... 175/75
6,769,499 B2 * 8/2004 Cargill et al. ..... 175/73
7,188,685 B2 3/2007 Downton et al.
2005/0109542 A1 * 5/2005 Downton ..... 175/73

FOREIGN PATENT DOCUMENTS

GB 2408526 6/2005

OTHER PUBLICATIONS

Canadian Examination Report from the equivalent Canadian patent application No. 2590309 issued on Feb. 21, 2012.
Search report for the equivalent GB patent application No. 0709941.9 issued on Aug. 23, 2007.

* cited by examiner

*Primary Examiner* — David Andrews
(74) *Attorney, Agent, or Firm* — Chadwick A. Sullivan; Wesley Noa

(57) ABSTRACT

The present invention relates to a rotary steerable drilling apparatus which separates the drill string from the bottom hole assembly thereby allowing the biasing means to push the bit in a given direction without having to lift the drill string along with the bottom hole assembly.

9 Claims, 1 Drawing Sheet

ROTARY STEERABLE DRILLING APPARATUS AND METHOD

BACKGROUND OF THE INVENTION

This invention relates generally to oilfield downhole tools and more particularly to a rotary steerable drilling apparatus utilizing a universal joint reducing the forces experienced by a bias unit in pushing the bit in the preferred drill path.

To obtain hydrocarbons such as oil and gas, boreholes or wellbores are drilled by rotating a drill bit attached to the bottom of a bottom hole assembly ("BHA"). The drilling assembly is attached to the distal end of a drill string comprised of a plurality of tubulars or a relatively flexible spoolable tubing string commonly referred to as "coiled tubing." The section comprising the tubing and the drilling assembly is generally referred to as the "drill string." When a jointed pipe is used as the tubing, the drill bit is rotated by rotating the jointed pipe from the surface or by a mud motor attached to the tubing proximate the drill bit, or preferably both rotation and continuous directional drilling with the BHA. In the case of coiled tubing, the drill bit is rotated by a mud motor. Coiled tubing or flexible tubing may not withstand the rotational torque required in drilling. As either type of drilling occurs, a drilling fluid can be pumped to the drill bit discharging through jets in the drill bit to lubricate and cool the bit and to move rock crushed by the drill bit to the surface. The mud motor uses the hydraulic power of this drilling fluid to power the drill bit.

A substantial portion of current drilling activity involves drilling of directionally deviated wells to fully exploit a given set of geological formations from a single drilling platform. This is especially true of offshore drilling platforms which have daily operating costs. Current drilling programs can provide any number of proposed drill paths to exploit the reservoir from a single location. Such boreholes can provide very complex well profiles. To drill such profiles, bottom hole assemblies are normally provided with a plurality of independently operable force application members to apply force on the wellbore wall during drilling to move the drill bit along a prescribed path.

Continuously rotating directional drilling tools supported by the present invention eliminate slide drilling, improve hole cleaning, increase production rates and reduce the risk of differential sticking. Slide drilling occurs when drilling with a mud motor rotating the bit downhole without rotation of the drillstring from the surface. Slide drilling was required when directional drilling was principally accomplished with bent subs or a bent housing mud motor or some combination of those devices. Slide drilling is eliminated by rotary steerable drilling systems.

Rotary steerable drilling systems are often classified as either "point-the-bit" or "push-the-bit" systems. In point-the-point systems, the rotational axis of the drill bit is deviated from the longitudinal axis of the drill string in the direction sought by the drilling program. In push-the-bit drilling programs, the required directionality is achieved by causing a stabilizer located adjacent the drill bit or remotely from the drill bit to apply an eccentric force on the BHA to move the drill bit in the desired path. Generally, the drill bit is moved into engagement with the borehole face by selective eccentric movement at two other stabilizer locations in the BHA.

As previously noted, rotary steerable drilling apparatus have been developed and are well known in this art for using the flow of drilling fluid to the drill bit to selectively actuate pads or pistons which urge the drill bit along a desired path at the borehole face. These pads may be activated by either hydraulic forces or electromotive forces to move into engagement with the well bore to thereby move or urge the drill bit in a given direction. The force that may be asserted against the pads is generally limited by both the available pressure difference and the piston diameter. Often, the hydraulic force available to push the pad into engagement with the well bore wall is insufficient to both lift the BHA and affixed drill string from the well bore wall and bend the BHA in the desired direction. By strategically integrating a universal joint in the BHA, the effective weight and bending stiffness of the drill string can be significantly reduced and with the same force output, the performance of the rotary steerable drilling apparatus can be dramatically increased.

SUMMARY OF INVENTION

The present invention is a steerable bottom hole assembly for use in a well bore made up, at a minimum, with a universal joint connectable to a drill string; a control bias unit connected to the universal joint; and, a drill bit connected to the control bias unit. A stabilizer can be placed adjacent the universal joint thereby minimizing the energy required by the bias pads to move the BHA from the well bore wall. Furthermore, in another embodiment, the stabilizer placed adjacent the universal joint can be undergauge. The universal joint of the present invention provides a low bending stiffness relative to the control bias unit and the drill string to which is attached thereby making the movement of the BHA independent from the movement of the balance of the drill string.

As may be readily appreciated, in conventional rotary steerable systems, the control bias unit comprises a control unit for receiving signals from sensors and transmitting a signal to the bias unit and a bias unit for converting such signal into movements of one or more bias pads against an adjacent face of the well bore. In a highly deviated well, the drill string must be moved in unison with the bottom hole assembly upon actuation of the bias pads in to the desired path. The force required to move the BHA and the attached drill string is often too great to accomplish either goal efficiently, thereby forcing the drill path into a larger than desired turning radius, exhibiting less dogleg severity.

Using the method of drilling a well bore with the current invention requires attaching a universal joint to a drill string below a stabilizer; attaching a control bias unit to the universal joint; attaching a drill bit to the control bias unit; and, turning the drill bit while actuating the control bias unit to move the drill bit in a desired direction.

Another method of assembling a bottom hole assembly for drilling a well bore uses the steps of: attaching a drill bit to a bias unit; attaching the bias unit to a control unit; attaching the control unit to a universal joint; attaching the universal joint to a stabilizer; and, attaching the stabilizer to a tubular drill member. The drill member can be either a mud drilling motor or a drill string.

DETAILED DESCRIPTION OF THE DRAWINGS

For a detailed understanding of the present invention, reference should be made to the following detailed description of a preferred embodiment, taken in conjunction with the accompanying drawings, in which like elements have been given like numerals.

DETAILED DESCRIPTION OF THE INVENTION

Figure 1:
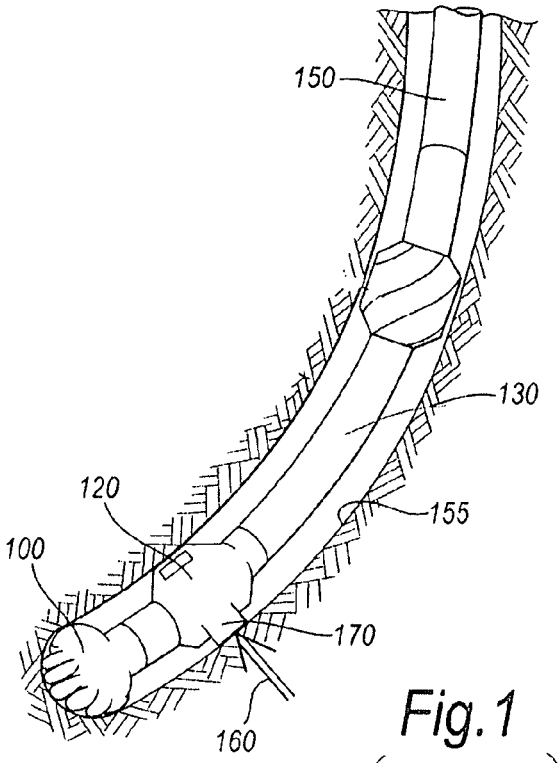
Fig. 1 (PRIOR ART)
FIG. 1 is a schematic drawing of the prior art steerable bottom hole assembly.

FIG. 1 shows a typical steerable BHA consisting of a drill bit 100 connected to a bias unit 120. Bias unit 120 operates during rotational drilling by moving actuator pads or pistons 170 into engagement with a bore hole wall 155 at a point or fulcrum 160 to move the drill bit 100 and bias unit 120 in a preferred direction as determined by the sensors located in control unit 130. The method of controlling a deviated well by activating a rotary steerable bias unit is more fully described in U.S. patent application Ser. No. 10/248,053, filed Dec. 13, 2002, and the patents cited therein, all of which are incorporated herein by reference.

As may be readily appreciated, when the unit is in the position shown in FIG. 1, the bias unit 120 can be required to lift the entire weight of the drill string and BHA off of the well bore wall. This can be a problem in unconsolidated and/or soft formations. Additionally, the bias unit 120 can be required to overcoming the flexural rigidity of the drill string 150 and BHA to accomplish the change in direction sought. The dogleg severity or build angle is limited by the relative stiffness of the drill string and BHA subassembly.

Figure 2:
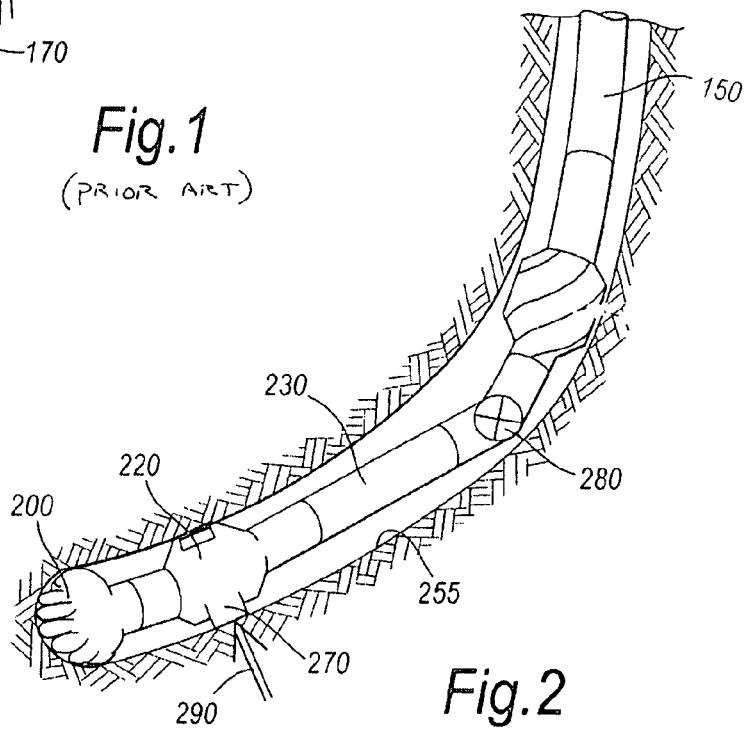
FIG. 2 is a schematic drawing of the steerable bottom hole assembly with an integral universal joint placed between the stabilizer and the bottom hole assembly.

In contrast, FIG. 2 shows the arrangement of the bias unit to the universal joint which is fabricated with sufficient flexibility to allow the bottom hole assembly to move freely without the need to move the remaining portion of the drill string adjacent the BHA. The force necessary to direct the bit in the desired direction is substantially less than the force necessary to direct the bit in the conventional arrangement shown in FIG. 1. A drill bit 200, in FIG. 2, is connected to a bias unit 220 in the conventional manner well known to those skilled in this art. Bias unit 220 is actuated by a signal received from a control unit 230 adjacent the bias unit. Control unit 230, in the present embodiment, is connected to a universal joint 280 which is integrally attached to the drill string. Integrally attached means that the BHA attached below the universal joint turns at the same speed as the rotation of the drill string, thus allowing constant rotation of the entire BHA. By permitting angular displacement at the universal joint, bias unit 220 need only move drill bit 200 and control unit 230 off the well bore wall 255 by selectively extending pads, such as pad 270, with sufficient force reflected at location 290 into the correct position to drill in the desired path. The universal joint can have a conduit for fluid communication with the drillstring and bit, while keeping separate the flow of fluid outside the drillstring. The universal joint can be constructed to withstand the forces of drilling.

By providing the universal joint 280 at this location in the BHA, the dogleg severity can be greatly increased, thereby allowing substantially greater build angle to be achieved. The universal joint can save wear-and-tear on the drilling assembly and bias unit through the reduction of weight that the bias unit must overcome each time it directs the drilling process. In addition to saving the equipment, since the bias unit can assert less force on a formation, the formation will receive less damage from the bias unit.

The use of the integral universal joint 280 combines the benefits of the steerable directional drilling systems with rotary drilling systems thereby permitting better fluid flow around the drill string than previously experienced with slide drilling. Hole spiraling, a feature of drilling completions encountered in bore holes using mud motors and slide drilling, is minimized thereby permitting larger casing to be set deeper in the hole. Continuous rotation allows more consistent weight on the bit thereby permitting increases in rates of penetration. Continuous rotation allows better hole cleaning by agitating the drilling fluid and cuttings, thereby allowing them to flow out of the hole rather than accumulate and plug the well. Continuous rotation also lessens the opportunity for differential wall sticking which is more likely to occur when a drill string is not continuously moved while in contact with a well bore wall.

Although only a few exemplary embodiments of this invention have been described in detail above, those skilled in the art can readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicants not to invoke 35 U.S.C. §112, paragraph 6 for any limitations of any of the claims herein, except for those in which the claim expressly uses the words "means for" together with an associated function.

What is claimed is:

1. A steerable bottom hole assembly for use in a well bore comprising:

a universal joint connectable to a distal end of a drill string to allow the steerable bottom hole assembly to pivot freely at the universal joint without causing bending of the drill string;

a control unit;

a bias unit; and a drill bit, the control unit and the bias unit being located between the drill bit and the universal joint such that the control unit, the bias unit, and the drill bit are located below the universal joint, wherein the control unit, the bias unit, and the drill bit are constrained to rotation at the same speed as rotation of the drill string.

2. The steerable bottom hole assembly of claim 1 further comprising: a stabilizer adjacent the universal joint on the distal end of the drill string.

3. The system steerable bottom hole assembly of claim 2 wherein the stabilizer is undergauge.

4. The steerable bottom hole assembly of claim 1 wherein the control unit provides a signal output to steer the drill bit along a given path in the well and the bias unit converts such signal into movements of one or more bias pads against an adjacent face of the well bore.

5. A rotary steerable bottom hole assembly comprising:

a drill bit;

means for biasing the drill bit in a particular direction in response to signals received from a control unit; and, means for coupling to a drill string, the means for coupling being positioned on an opposite side of the means for biasing relative to the drill bit, the means for coupling allowing rotation in three planes using a universal joint, said universal joint providing a low bending stiffness relative to means for biasing the drill bit and further being integrally attached to said drill string such that said drill bit, said means for biasing the drill bit and said drill string are rotatable only at the same speed.

6. The rotary steerable bottom hole assembly of claim 5 further comprising: a stabilizer attached between the drill string and the means for coupling to a drill string allowing rotation in three planes.

7. The rotary steerable bottom hole assembly of claim 6 wherein the stabilizer is undergauge thereby allowing greater bend angle.

8. A method of drilling a well bore, comprising:

attaching a universal joint having a low bending stiffness relative to a control bias unit to a portion of a drill string below a stabilizer;

attaching the control bias unit to the universal joint; said control bias unit being integrally attached to the portion of the drill string such that said control bias unit and stabilizer are constrained to rotate at the same speed;

attaching a drill bit to the control bias unit such that the drill bit is constrained to rotate with the control bias unit; and, turning the drill bit with the drill string while actuating the control bias unit to move the drill bit in a desired direction.

9. A method of assembling a bottom hole assembly for drilling a well bore, comprising:

attaching a drill bit to a bias unit;

attaching the bias unit to a control unit;

attaching the control unit to a universal joint; and attaching the universal joint to a stabilizer; wherein said control unit is integrally attached to a drill member such that said drill bit, bias unit and stabilizer can rotate only at the same speed as the drill member.

* * * * *